US006019085A

United States Patent [19]

Sato et al.

[11] Patent Number: 6,019,085

[45] Date of Patent: Feb. 1, 2000

[54] THROTTLE VALVE CONTROL DEVICE FOR INTERNAL-COMBUSTION ENGINE

[75] Inventors: Kunihiko Sato, Okazaki; Kazutaka Nonoyama, Kariya, both of Japan

[73] Assignees: Toyota Jidosha Kabushiki Kaisha, Toyota; Denso Corp., Kariya, both of Japan

[21] Appl. No.: 09/115,769

[22] Filed: Jul. 15, 1998

[30] Foreign Application Priority Data

Jul. 18, 1997 [JP] Japan ..... 9-194625

[51] Int. Cl.[7] ..... F02D 41/08; F02D 41/16

[52] U.S. Cl. ..... 123/339.22; 123/339.19

[58] Field of Search ..... 123/339.14, 339.16, 123/339.19, 339.2, 339.21, 339.22, 339.23, 339.25, 339.26

[56] References Cited

FOREIGN PATENT DOCUMENTS 7-34940 2/1995 Japan .

8-61124 3/1996 Japan .

11-36945 2/1999 Japan ..... 123/339.19

*Primary Examiner*—Tony M. Argenbright

*Attorney, Agent, or Firm*—Oliff & Berridge, PLC

[57] ABSTRACT

A throttle valve control device in an internal-combustion engine having an electronically-controlled throttle valve is provided for calculating a final target opening based on an engine operation state, which includes an accelerator depression amount, and an ISC request opening for adjusting a revolutional speed of the engine to a target revolutional speed during an idling operation, and for electronically controlling the throttle valve so as to adjust the throttle valve opening to the final target opening. The device of the present invention includes a correction section for correcting the ISC request opening based on an amount of variation in the revolutional speed of the engine when the final target opening is identical to the ISC request opening, while prohibiting the correction of the ISC request opening when the final target opening is not identical to the ISC request opening.

6 Claims, 7 Drawing Sheets

ΔNT=NE−NT
ΔNE=NE−NEO

Idling SW
ON
OFF

Accelerator opening
0
TANGLE≒TTAISC

Target throttle value opening (TANGLE)
Actual throttle valve opening
Non-idling state determination threshold value TAth
Non-linear target opening (TTAH)
ISC target opening (TTAISC)
Throttle valve fully closed NE
Target revolutional speed

ΔNE
+
0
−

DD
+
0
−

DD
+
0
−
Prior art: This correction lowers NE stability
t1
t2

THROTTLE VALVE CONTROL DEVICE FOR INTERNAL-COMBUSTION ENGINE

BACKGROUND OF THE INVENTION

1. Field of the Invention

The present invention relates to an internal-combustion engine having an electronically-controlled throttle valve, and more particularly to a throttle valve control device in an internal-combustion engine for electronically controlling the throttle valve so that the throttle valve opening is adjusted to a final target opening, which is calculated based on the engine operation state and an ISC request opening.

2. Description of the Related Art

During an idling state of an engine, a so-called ISC (Idling Speed Control) is performed. In ISC, an ISC valve is controlled so as to adjust the revolutional speed of the engine to the target revolutional speed. In ISC using an ISC valve, the idling revolutional speed is maintained at a target value by controlling the air amount (or intake amount) supplied to the engine independently of the throttle valve. In order to enhance the responsiveness of ISC, it has been proposed to correct an ISC amount based not only on the revolutional speed of the engine but also based on the variation in the revolutional speed (see, for example, Japanese Laid-Open Patent Application No. 7-34940).

In recent years, as the electronic control of the throttle valve of an internal-combustion engine has been realized, it has been proposed to perform ISC using the electronically-controlled throttle valve without separately providing an ISC valve. When such ISC is performed using a throttle valve, the idling opening of the throttle valve (i.e., the opening of the throttle valve during an idling state of the engine; hereinafter, referred to simply as the "idling opening") is set based on the variation in the throttle valve opening caused by ISC.

In such a throttle valve control, it is determined if the engine is in an idling operation based on predetermined conditions; and if so, ISC is performed as described above. The idling state determination is based on a comparison using a predetermined threshold value, a mechanically-designed idling switch of the throttle valve, or the like.

When a driver slightly depresses the accelerator during the idling operation of an internal-combustion engine, in response to this, the revolutional speed of the engine increases. However, if the throttle valve opening at that time does not exceed the idling opening range (i.e., the predetermined threshold value), it is still determined that the engine is in an idling operation, whereby the ISC amount (i.e., the throttle valve opening) is corrected in accordance with the variation in the revolutional speed which is caused by the depression of the accelerator. More specifically, the ISC amount is corrected so as to compensate for the increase in the revolutional speed caused by the depression of the accelerator. If the driver then removes their foot from the accelerator, the throttle valve opening required for an idling operation is no longer obtained, thereby lowering the revolutional speed of the internal-combustion engine.

Since the conventional throttle valve control device cannot reliably detect slight variances in the opening/closing of the accelerator, as described above, a slight depression of the accelerator during the idling operation lowers the stability of the revolutional speed of an internal-combustion engine.

SUMMARY OF THE INVENTION

According to one aspect of this invention, a throttle valve control device in an internal-combustion engine having an electronically-controlled throttle valve is provided for calculating a final target opening based on an engine operation state, which includes an accelerator depression amount, and an ISC request opening for adjusting a revolutional speed of the engine to a target revolutional speed during an idling operation, and for electronically controlling the throttle valve so as to adjust the throttle valve opening to the final target opening. The device includes a correction section for correcting the ISC request opening based on an amount of variation in the revolutional speed of the engine when the final target opening is identical to the ISC request opening, while prohibiting the correction of the ISC request opening when the final target opening is not identical to the ISC request opening.

In one embodiment of the invention, wherein the correction section corrects the ISC request opening based on, in addition to the amount of variation in the revolutional speed of the engine, a deviation between the revolutional speed of the engine and the target revolutional speed and a load variation.

In one embodiment of the invention, when a temperature of a coolant of the internal-combustion engine is equal to or less than a predetermined temperature, the correction section prohibits any correction of the ISC request opening based on the amount of variation in the revolutional speed of the engine which would decrease the ISC request opening.

In one embodiment of the invention, the correction section prohibits any correction of the ISC request opening based on the amount of variation in the revolutional speed of the engine which would decrease the ISC request opening, depending on the engine operation state.

In one embodiment of the invention, the correction section prohibits any correction of the ISC request opening when the revolutional speed of the engine is equal to or greater than a predetermined revolutional speed.

In one embodiment of the invention, the correction section determines a smoothed revolutional speed by averaging the revolutional speed of the engine, determines a dead zone based on the smoothed revolutional speed when the revolutional speed of the engine falls within a predetermined range, and prohibits any correction of the ISC request opening when the revolutional speed of the engine falls within the dead zone.

Thus, the invention described herein makes possible the advantage of providing a device for controlling a throttle valve of an internal-combustion engine, in which the responsiveness of ISC is improved, while the stability of the revolutional speed of the internal-combustion engine is not lowered even when the accelerator is so slightly depressed that the throttle valve opening does not exceed an idling opening.

This and other advantages of the present invention will become apparent to those skilled in the art upon reading and understanding the following detailed description with reference to the accompanying figures.

DESCRIPTION OF THE PREFERRED EMBODIMENTS

The present invention will be described by way of an example with reference to the accompanying drawings.

Figure 1:
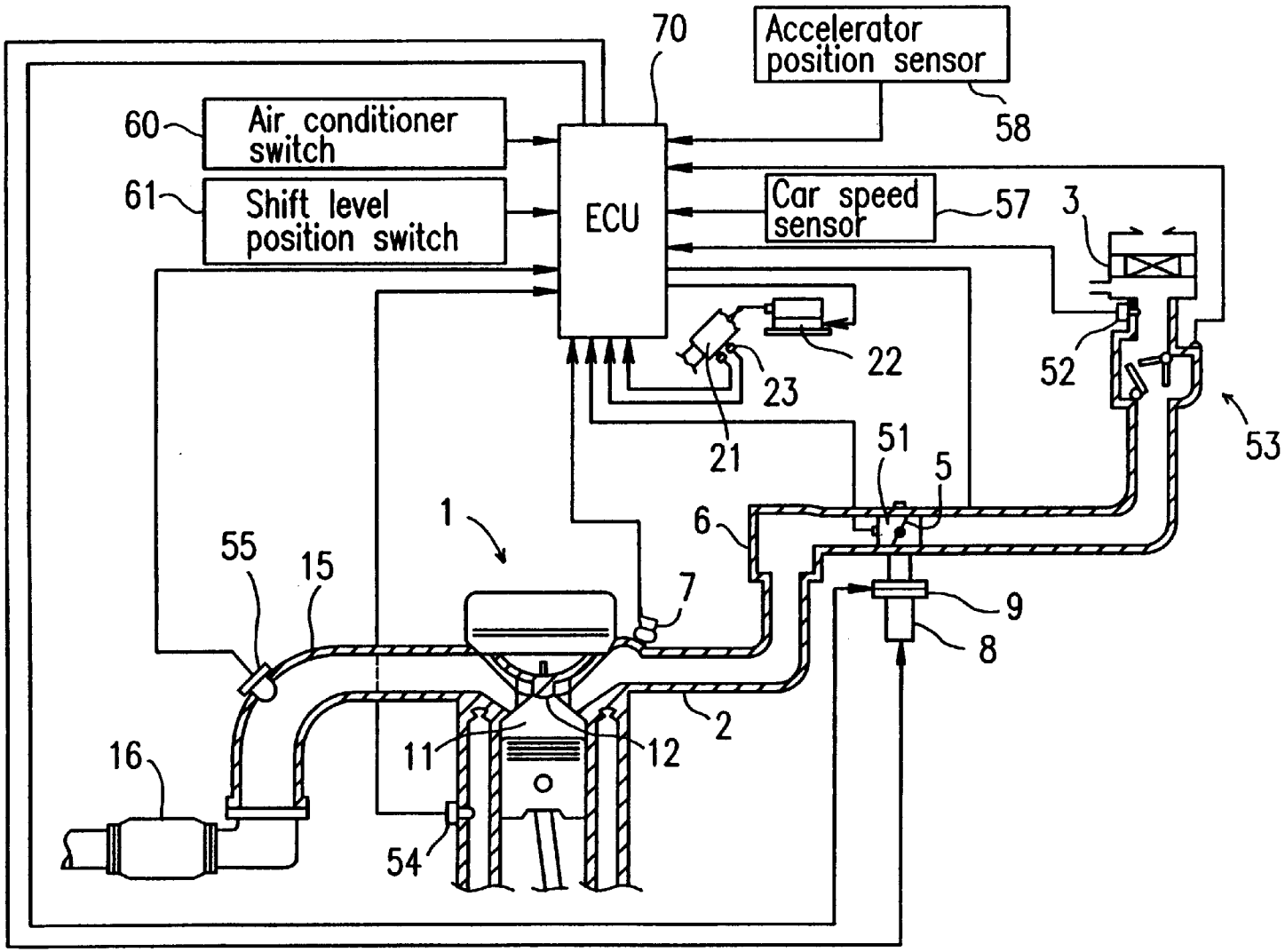
FIG. 1 is a diagram schematically illustrating a configuration of an engine of a vehicle which includes a throttle valve control device for an internal-combustion engine according to an example of the present invention, along with the peripheral devices thereof.

FIG. 1 is a diagram schematically illustrating a configuration of a throttle valve control device according to an example of the present invention which is used for an internal-combustion engine (engine 1) of a vehicle, along with the peripheral devices thereof.

As illustrated in FIG. 1, an air cleaner 3, a throttle valve 5, a surge tank 6 and a fuel injection valve 7 are provided in this order along an intake passage 2 from one end of the passage 2 through which the intake air is supplied. The intake air supplied via the intake passage 2 is mixed with fuel injected by the fuel injection valve 7, and then is supplied into a combustion chamber 11 of the engine 1. In the combustion chamber 11, a spark ignition of the fuel mixture is caused by an ignition plug 12, thereby driving the engine 1. The gas which has been combusted in the combustion chamber 11 (i.e., an exhaust gas) is guided via an exhaust passage 15 into a catalytic converter 16, where it is cleansed. Thereafter, the exhaust gas is discharged.

A high voltage is applied to the ignition plug 12 from an igniter 22 via a distributor 21. The timing of the voltage application defines the ignition timing. The distributor 21 is provided with a revolutional speed sensor 23.

The opening of the throttle valve 5 is electronically controlled by an ECU 70 (described later) using a DC motor 8 and an electromagnetic clutch 9. The actual opening of the throttle valve 5 is detected by a throttle position sensor 51. The throttle position sensor 51 includes an idling switch (not shown) provided therein for detecting the fully closed state of the throttle valve 5.

In addition to the revolutional speed sensor 23 and the throttle position sensor 51, the engine 1 is provided with other sensors for detecting the various operational states of the engine 1, including: an intake temperature sensor 52 provided along the intake passage 2 for detecting the temperature of the intake air; an air flowmeter 53 for detecting the intake amount; a water temperature sensor 54 provided in the cylinder block for detecting the temperature of a coolant; an oxygen concentration sensor 55 provided along the exhaust passage 15 for detecting the oxygen concentration in the exhaust gas; a car speed sensor 57 for detecting the speed of the vehicle; and an accelerator position sensor 58 for detecting the accelerator opening (the amount the accelerator is depressed).

Other sensors may further be provided, including: an air conditioner switch 60 for detecting the working condition of an air conditioning device; and a shift lever position switch 61 for indicating a range position of the automatic transmission (or torque converter).

Figure 2:
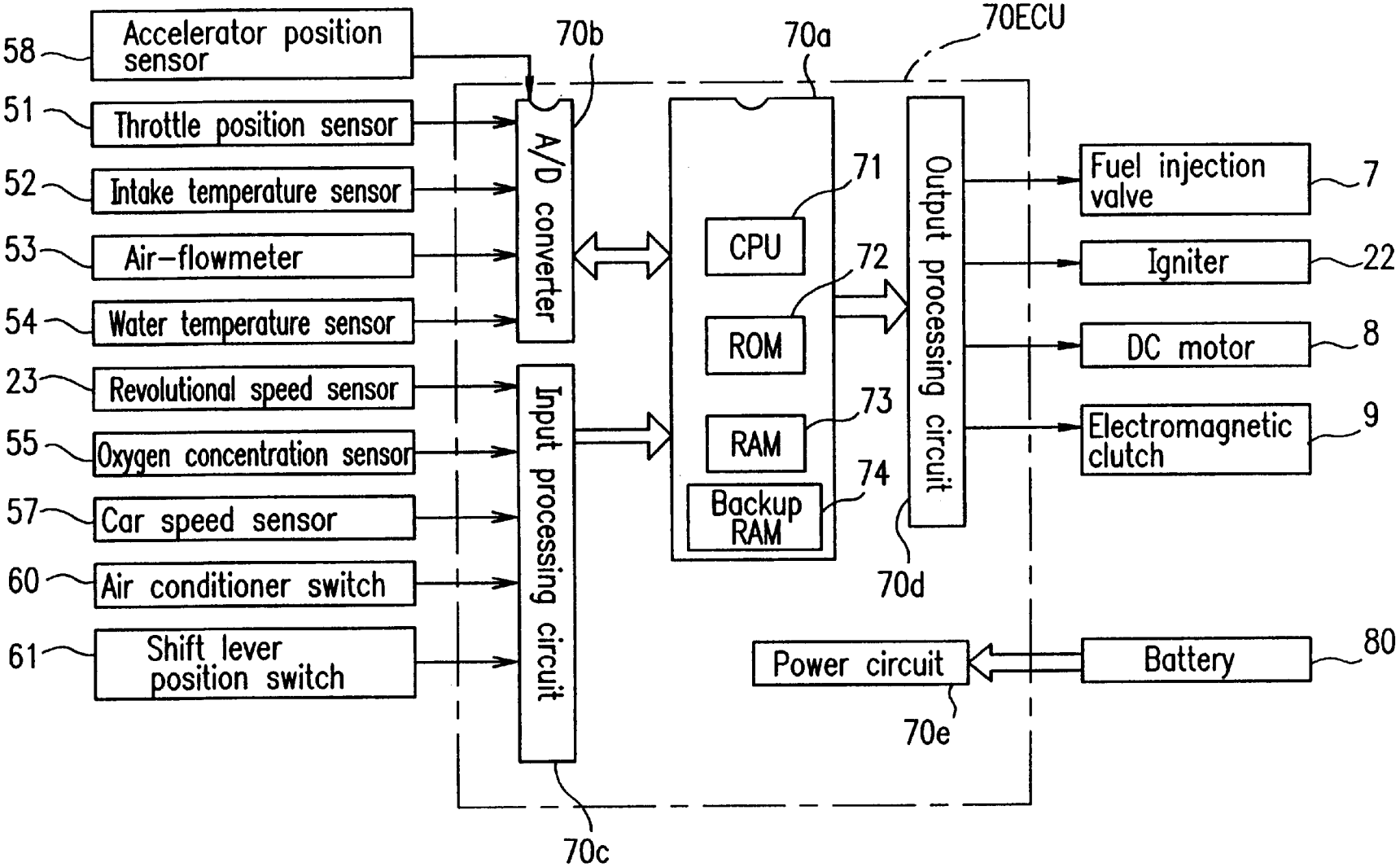
FIG. 2 is a block diagram illustrating one configuration for a control system including an ECU (electronic control unit) as its main component.

The respective detected signals from these sensors and switches are input to the ECU 70. As illustrated in FIG. 2, the ECU 70 is configurated to have a logic operation processing circuit 70*a* which includes a microcomputer as its main component. The logic operation processing circuit 70*a* includes: a CPU 71 for executing various arithmetic operations required for controlling the engine 1 in accordance with a prescribed control program; a ROM 72 for storing the control program, control data, or the like, required for executing the various arithmetic operations; a RAM 73 for temporarily storing data used in executing the various arithmetic operations; and a backup RAM 74 for storing data when the power is turned off. The detected signals from the above-described sensors and switches are input to the operation processing circuit 70*a* via an A/D converter 70*b* or an input processing circuit 70*c*. Moreover, various driving signals produces in accordance with the operation result of the operation processing circuit 70*a* are provided to the fuel injection valve 7, the DC motor 8, the electromagnetic clutch 9, the igniter 22, etc., via an output processing circuit 70*d*. The ECU 70 further includes a power circuit 70*e* which is connected to a battery 80, so that a high voltage can also be applied from the output processing circuit 70*d*.

When an IG (ignition) switch is turned on at the start of the engine 1, the ECU 70 starts controlling the opening of the throttle valve 5 by supplying an electric current through the DC motor 8 and the electromagnetic clutch 9. The ECU 70 performs a fuel injection control and an ignition timing control by driving and controlling the fuel injection valve 7, the DC motor 8, the igniter 22, etc., and also performs an idling revolutional speed control, etc., by electronically controlling the throttle valve 5, in accordance with the operation conditions of the engine 1 detected by the above-described sensors and switches.

When controlling the idling revolutional speed, the final target opening (target throttle valve opening TANGLE) is first calculated based on the operation conditions of the engine 1 and on the ISC request opening (described later). The ISC request opening is used for adjusting the revolutional speed of the engine 1 to the target revolutional speed during an idling operation. Then, the actual throttle valve opening is detected by the throttle position sensor 51, as described above, and the DC motor 8 is driven by a PID (proportional integral and differential) control so as to electronically control the throttle valve 5 to adjust the actual throttle valve opening to the final target opening. When the final target opening is identical to the ISC request opening, the ISC request opening is corrected based on the deviation $\Delta NT$ of the actual revolutional speed NE of the engine 1 and on the variation $\Delta NE$ of the actual revolutional speed NE. However, when the final target opening is not identical to the ISC request opening, correction of the ISC request opening is prohibited.

Hereinafter, idling revolutional speed control according to the present example will be described in more detail referring to FIGS. 3 to 5.

In the present example, idling revolutional speed control is performed by the CPU 71 in the ECU 70. An idling revolutional speed control routine is executed for every passage through a predetermined crank angle, e.g., 180° CA.

Figure 3:
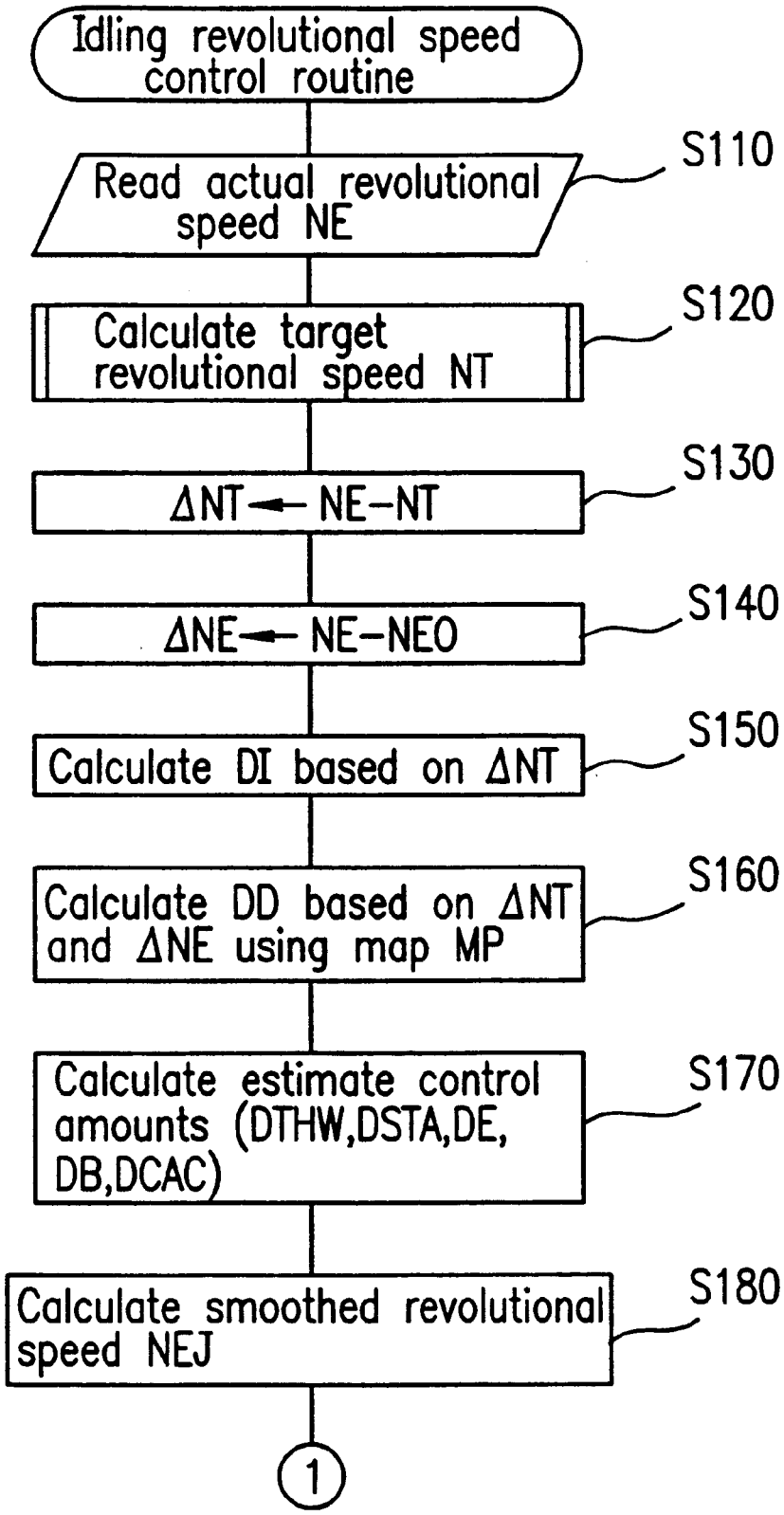
FIG. 3 is a flow chart illustrating the first half of an idling revolutional speed control routine which is executed by a CPU in the ECU.

As illustrated in FIG. 3, when the idling revolutional speed control routine is initiated, the CPU 71 first reads the actual revolutional speed NE detected by the revolutional speed sensor 23 (step S110). Then, the target revolutional speed NT is calculated (step S120). As is well known in the art, the target revolutional speed NT is calculated based on the actual revolutional speed NE of the engine 1, the coolant temperature THW detected by the water temperature sensor 54, the load on a compressor of the air conditioner which is determined by the air conditioner switch 60, the load on the automatic transmission which is detected by the shift lever position switch 61, etc.

Then, the revolutional speed deviation ΔNT is obtained by subtracting the target revolutional speed NT calculated in step S120 from the actual revolutional speed NE read in step S110 (step S130). Thus ΔNT=NE−NT.

Next, for the actual revolutional speed NE read in step S110, the variation ΔNE in the revolutional speed during a predetermined period of time is determined by subtracting a value NEO, which is read during the previous execution of the routine, from the value NE, which is read during the current execution of the routine (step S140). This, ΔNE=NE−NEO.

Following step S140, steps S150 to S170 are performed to determine variables used for setting driving signals for electronically controlling the throttle valve 5. Hereinafter, this process will be described in detail.

First, a variable DI is calculated based on the revolutional speed deviation ΔNT calculated in step S130 (step S150). The variable DI is a correction amount which corresponds to the feedback control term, and is an integrated amount which is determined by the revolutional speed deviation ΔNT. The variable DI is calculated from the revolutional speed deviation ΔNT using a map which has been stored, in advance, in the ROM 72. The calculation of the variable DI using a map is well known in the art, and thus will not be described in further detail.

Next, a variable DD is calculated based on the revolutional speed deviation ΔNT calculated in step S130 and the revolutional speed variation ΔNE calculated in step S140 (step S160). The variable DD is also a correction amount which corresponds to the feedback control term, like the variable DI, but the variable DD realizes a faster responsiveness. The variable DD is calculated using a map MP which has been stored in the ROM 72 in advance.

Figure 5:
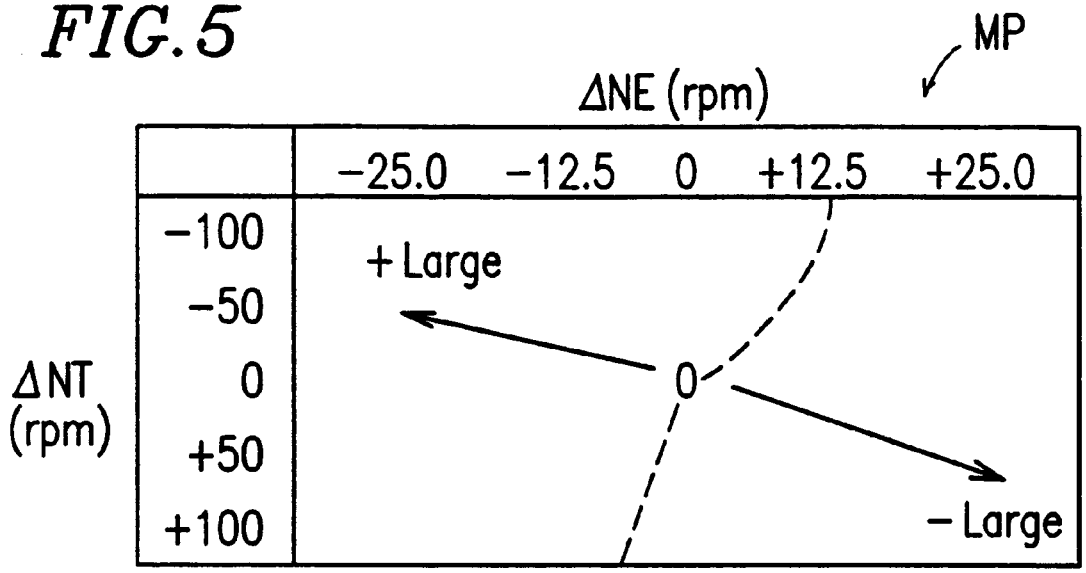
FIG. 5 is a graph illustrating an exemplary map MP which is used in calculating a variable DD.

FIG. 5 schematically illustrates the map MP used for calculating the variable DD. As illustrated in FIG. 5, the map MP is a two-dimensional map which defines the variable DD, which is determined in accordance with ΔNE and ΔNT. The horizontal and vertical axes of the map MP represent the revolutional speed variation ΔNE and the revolutional speed deviation ΔNT, respectively. As illustrated in FIG. 5, in accordance with the map MP, the variable DD takes a value 0 when the value of ΔNE is around 0. As ΔNE becomes greater than 0 while ΔNT increases, the variable DD takes a greater negative value. On the other hand, as ΔNE decreases while ΔNT also decreases, the variable DD takes a greater positive value. As can be seen from comparing between the positive gain of the variable DD (i.e., an increase in DD) and the negative gain thereof (i.e., a decrease in DD), the negative gain is set to be less than the positive gain, in order to ensure engine stall prevention. Note also that, within a predetermined region of the map MP where ΔNE and ΔNT take small absolute values, the variable DD takes a value close to 0, thereby suppressing the gain thereon in this region.

Next, estimate correction amounts for suppressing the influence of the load variation are calculated (step S170). The load variation occurs, for example, at the start of the air conditioner, or at the time when the automatic transmission is shifted into the D range. The estimate correction amounts include: a warming-up correction amount DTHW which is set when the coolant temperature THW is equal to or less than a predetermined temperature; a starting correction amount DSTA which is set when the ignition switch is turned to the start position; a D range correction amount DE which is set when the automatic transmission is shifted into the D range; an electric correction amount DB which is set when the head lamp switch is turned on; an air conditioner correction amount DCAC which is set when the air conditioner switch is turned on; etc. The ISC request opening TTAISC is determined based on these estimate correction amounts and on the detection result of the car speed sensor 57. The process of setting these correction amounts is well known in the art, and thus will not be described in further detail.

Following step S170, a smoothed revolutional speed NEJ is calculated by averaging the actual revolutional speed NE read in step S110 (step S180). The smoothed revolutional speed NEJ represents an averaged revolutional speed which is determined by calculating the load average of the obtained smoothed revolutional speed $NEJ_{i-1}$ and the read actual revolutional speed $NE_i$. For example, it can be determined by calculating $NEJ_i=(7\times NEJ_{i-1}+NE_i)/8$.

Figure 4:
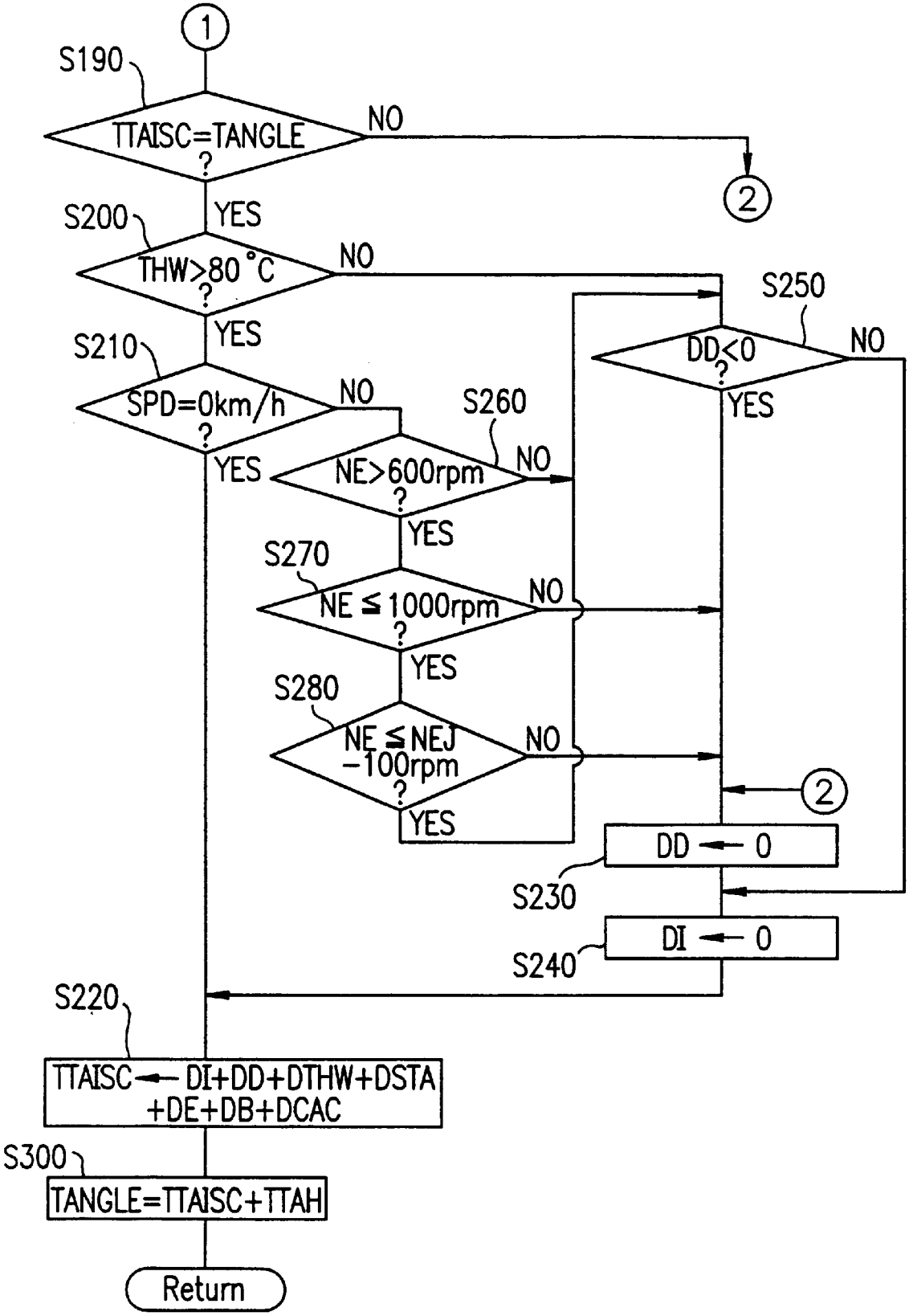
FIG. 4 is a flow chart illustrating the latter half of an idling revolutional speed control routine which is executed by the CPU in the ECU.

Next, as illustrated in FIG. 4, it is determined in steps S190 to S210 whether the engine 1 is in the idling state and whether the ISC request opening TTAISC should be corrected. The ISC request opening TTAISC is corrected only when predetermined conditions are satisfied in these steps. This will be described below in detail.

First, in step S190, it is determined whether the ISC request opening TTAISC is identical to the target throttle valve opening TANGLE.

As described above, the ISC request opening TTAISC is calculated as an amount which includes the estimate correction amounts (i.e., the warming-up correction amount DTHW, the starting correction amount DSTA, the D range correction amount DE, the electric correction amount DB, the air conditioner correction amount DCAC, etc.). Moreover, the target throttle valve opening TANGLE is calculated in step S300 (described later) by adding a non-linear target opening TTAH, which is calculated from the accelerator opening detected by the accelerator position sensor 58, to the ISC request opening TTAISC. Thus, TANGLE=TTAISC+TTAH. When there is any depression of the accelerator, the non-linear target opening TTAH 0. Therefore, TANGLE TTAISC is determined in step S190.

Figure 6:
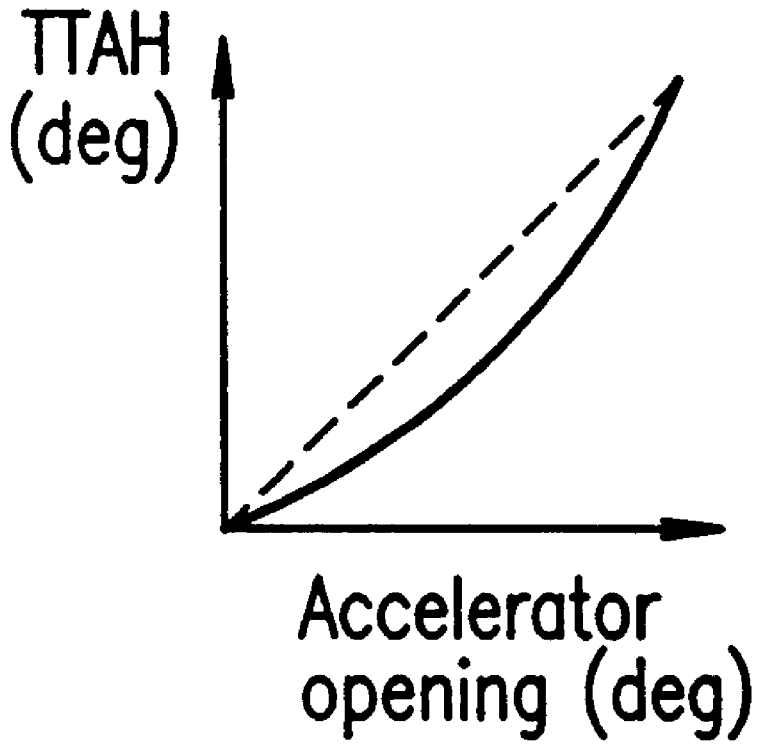
FIG. 6 is a graph illustrating the characteristics of a non-linear target opening TTAH.

FIG. 6 illustrates the characteristics of the non-linear target opening TTAH. Note that the non-linear target opening TTAH may in some cases be substituted by a request opening from another system which is not illustrated herein (e.g., a cruise control, VSC (Vehicle Stability Control), etc.).

If the ISC request opening TTAISC is identical to the target throttle valve opening TANGLE in step S190, it is further determined whether the coolant temperature THW detected by the water temperature sensor 54 is greater than a predetermined value (e.g., 80° C.) (step S200), and whether the car speed SPD detected by the car speed sensor 57 is 0 [km/h] (step S210). When the determinations in steps S200 and S210 are both affirmative, it is determined that the engine 1 is in a normal idling state, and the process then proceeds to S220.

In step S220, the ISC request opening TTAISC is corrected using the variables DI and DD) which are feedback control terms determined in steps S150 to S170. In particular, the value obtained by adding together the feedback control terms (DI and DD and the estimate correction amounts (DTHW, DSTA, DE, DB, DCAC, etc.) is used as the ISC request opening TTAISC.

Then, in step S300, the target throttle valve opening TANGLE for electronically controlling the throttle valve 5 is determined by adding the non-linear target opening TTAH, which is calculated from the accelerator opening detected by the accelerator position sensor 58, to the ISC request opening TTAISC, which has been corrected in step S220. Thus, the target throttle valve opening TANGLE is calculated by TANGLE=TTAISC+TTAH. Then, the execution of the routine ends.

In the determination in step S190, when the ISC request opening TTAISC is not identical to the target throttle valve opening TANGLE (i.e., non-linear target opening TTAH 0), the variables DD and DI, which are the feedback control terms, are reset to 0 (steps S230 and S240). In other words, correction by the feedback control terms is prohibited, so as to prevent an excessive correction which may occur when the accelerator is slightly depressed, thereby preventing the revolutional speed of the engine from becoming instable.

Figures 7A, 7B, 7C, 7D, 7E, 7F, 7G:
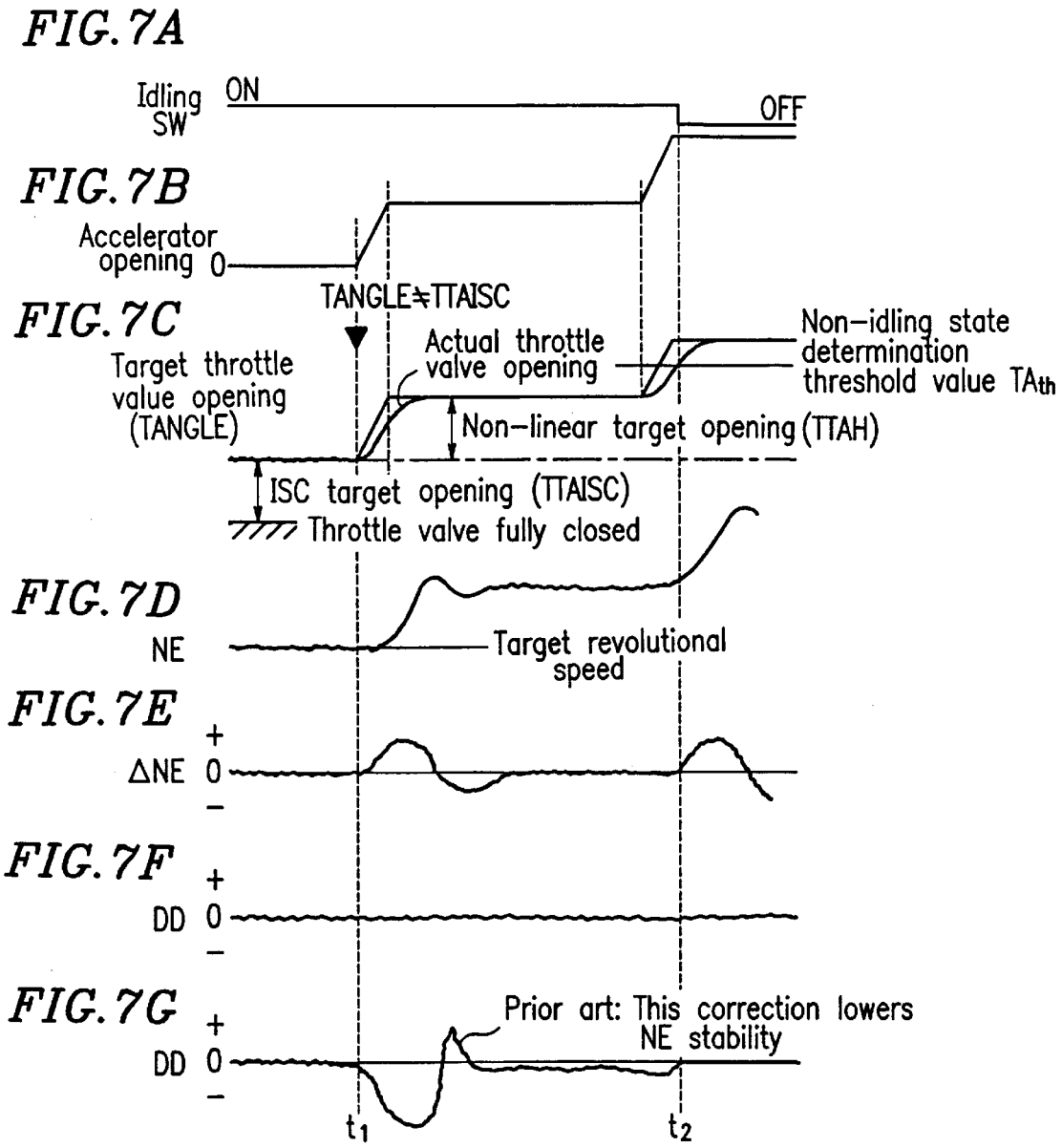
FIGS. 7A to 7F each show a timing diagram illustrating an exemplary control of a throttle valve during an idling operation in accordance with the present examples.
FIG. 7G shows a timing diagram illustrating a conventional throttle valve control for comparison.

FIGS. 7A to 7G each show a timing diagram illustrating an exemplary control of the throttle valve 5 during an idling operation in accordance with the present example. Note that FIG. 7F illustrates only the variable DD as an example of the feedback control term; and FIG. 7G illustrates a conventional throttle valve control for comparison.

The idling switch provided in the above-described throttle position sensor 51 is designed to be turned off at a predetermined threshold value $TA_{th}$ of the actual opening (non-idling state determination threshold value) (FIGS. 7A and 7C). When the accelerator is slightly depressed (accelerator opening 0) at time $t_1$, the throttle valve opening and the actual revolutional speed NE of the engine increase in response to this (FIGS. 7B to 7D). FIG. 7E illustrates the revolutional speed variation ΔNE of the engine. However, since the actual throttle valve opening is still less than the non-idling state determination threshold value $TA_{th}$, the idling switch remains on.

In the conventional throttle valve control, as illustrated in FIG. 7G, a correction is made compensating for the revolutional speed variation ΔNE using the fast-responding control term DD, thereby lowering the stability of the actual revolutional speed NE. On the other hand, in accordance with the present example, as illustrated in FIG. 7C, the target throttle valve opening TANGLE is not identical to the ISC request opening TTAISC at time $t_1$, when the accelerator is depressed, whereby the feedback control is prohibited by step S230 following the negative determination in step S190. Thus, as illustrated in FIG. 7F, any erroneous correction by the variable DD is prevented, whereby it is possible to stably control the revolutional speed.

The values of the estimate control terms DTHW, DSTA, DE, DB, DCAC, etc., are maintained as they are calculated in step S170 since they are required to prevent engine stall. After the feedback control term is set to 0 in step S240, the process proceeds to the above-described step S220, where the ISC request opening TTAISC is calculated based only on the estimate control amounts. Thereafter, step S300 is executed in a manner similar to that described above. Then, the execution of the routine ends.

When the determination in step S200 is negative, i.e., when it is determined that the coolant temperature THW is equal to or less than 80° C., the process proceeds to step S250. In step S250, it is determined whether the variable DD has a negative value. When the variable DD is negative, it is reset to 0 (step S230), and the variable DI is further reset to 0 (step S240). On the other hand, when it is determined in step S250 that the value of the variable DD is equal to or greater than 0, the process proceeds to step S240 so as to reset only the variable DI to 0 (step S240), while not resetting the variable DD to 0.

As described above, when the determination in step S200 is negative, it is determined that the engine is operating in a cold start condition where the coolant temperature THW is 80° C. or less. Therefore, the variable DD is protected so as to have a value of 0 or greater in order to control the engine safely in view of engine stall prevention. The feedback control term DI is reset to 0 since it is determined that the engine is in a cold start condition, but not in a normal idling state.

When the determinations in steps S190 and S200 are both affirmative and it is determined that the car speed SPD is not 0 [km/h], ISC is performed as follows. Such a series of determinations represent a situation where the engine is in the idling state and is coasting. In such a case, the variable DI is reset to 0 because the vehicle is running, and thus a normal feedback control is not necessary. The variable DD is maintained as determined in step S160 when appropriate in view of engine stall prevention.

When it is determined in step S210 that the car speed SPD is not 0 [km/h], the range of the actual revolutional speed NE read in step S110 is determined in steps S260 to S280, and the subsequent process is performed depending on the determined range of the actual revolutional speed NE. First, it is determined whether the actual revolutional speed NE is greater than 600 [rpm] (step S260). When the determination in step S260 is negative, i.e., when the actual revolutional speed NE is equal to or less than 600 [rpm], the process proceeds to step S250. In such a case, since the engine is at a low revolutional speed even though the vehicle is running, engine stall prevention is preferentially ensured, and the variable DD is protected so as to have a value of 0 or greater while the variable DI is reset to 0.

When the determination in step S260 is affirmative, it is further determined whether the actual revolutional speed NE is 1000 [rpm] or less (step S270). When the determination in step S270 is negative, i.e., when it is determined that the actual revolutional speed NE is greater than 1000 [rpm], the process proceeds to step S230. In such a case, since the actual revolutional speed NE is in a sufficiently stable range, it is not necessary to set the variable DD in view of preventing engine stall. Thus, the variables DD and DI are both reset to 0.

When the determinations in steps S260 and S270 are both affirmative (i.e., when the actual revolutional speed NE is greater than 600 [rpm] and equal to or less than 1000 [rpm]), the process proceeds to step S280. In step S280, it is determined whether the actual revolutional speed NE is equal to or less than a value obtained by subtracting 100 [rpm] from the smoothed revolutional speed NEJ, which is calculated in step S180. Thus, when the actual revolutional speed NE is in the range of 600<NE≦1000 [rpm], a dead zone of 100 [rpm] is provided from the smoothed revolutional speed NEJ, which is calculated in step S180, and it is determined whether the actual revolutional speed NE has moved out of this dead zone. When the determination in step S280 is affirmative, i.e., when the actual revolutional speed NE is equal to or less than the value (NEJ~100 [rpm]), it is determined that NE has moved out of the dead zone, and the process then proceeds to step S250. In such a case, the variation in the actual revolutional speed NE is suppressed depending on the value of the variable DD. Note that the variable DD is also protected in such vehicle operations, as in a cold start condition, so as to have a value of 0 or greater in order to control the engine safely in view of engine stall prevention.

On the other hand, when the determination in step S280 is negative, i.e., when the actual revolutional speed NE is within the dead zone, which is provided from the smoothed revolutional speed NEJ, it is determined that the feedback control is not necessary, and the variables DD and DI are both reset to 0 (steps (S230 and S240).

After the variables DD and DI are adjusted in a manner described above in accordance with the range of the actual revolutional speed NE of the engine, the process proceeds to step S220, where the ISC request opening TTAISC is corrected in a manner similar to that described above.

In step S300, the target throttle valve opening TANGLE is calculated by adding the non-linear target opening TTAH to the ISC request opening TTAISC, which has been corrected in step S220. Then, the execution of the routine ends.

As described above in detail, the throttle valve control device according to the present example employs a variable DD calculated based on a revolutional speed deviation ΔNT and a revolutional speed variation ΔNE, in addition to a variable DI calculated based on the revolutional speed deviation ΔNT, as feedback control terms for electronically controlling the throttle valve 5. Therefore, it is possible to control the opening of the throttle valve 5 while adjusting the control amount depending on the revolutional speed variation ΔNE as well as on the difference between the actual revolutional speed NE and the target revolutional speed NT. As a result, it is possible to appropriately correct variations in the revolutional speed of the engine 1 in accordance with the degree of variation, and thus improve the converging property of the actual revolutional speed NE to the target revolutional speed NT, thereby improving the responsiveness of the control.

Moreover, in accordance with the present example, the ISC request opening TTAISC is corrected using the feedback control term only when the ISC request opening TTAISC is identical to the target throttle valve opening TANGLE. In an electronically-controlled throttle system, when the accelerator is not depressed, the throttle valve is controlled so that the target throttle valve opening TANGLE=ISC request opening TTAISC, whereby it is possible to detect even a slight depression of the accelerator such that the idling switch is not turned off. Therefore, it is possible to prevent any excessive or erroneous correction by the feedback control terms (variables DD and DI) in response to the revolutional speed variation caused by the slight depression of the accelerator, thereby realizing a stable control of the revolutional speed of the engine.

As described above, the throttle valve control device for an internal-combustion engine of the present invention includes the correction section, which corrects the ISC request opening based on the variation in the revolutional speed of the engine when the final target opening is identical to the ISC request opening, while prohibiting the correction of the ISC request opening when the final target opening is not identical to the ISC request opening. Thus, it is possible to improve the responsiveness of ISC in an electronically-controlled throttle, and to stably control the revolutional speed of the internal-combustion engine even when the accelerator is so slightly depressed that the throttle valve opening does not exceed an idling opening.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A throttle valve control device in an internal-combustion engine having an electronically-controlled throttle valve, for calculating a final target opening based on an engine operation state, which includes an accelerator depression amount, and an ISC request opening for adjusting a revolutional speed of the engine to a target revolutional speed during an idling operation, and for electronically controlling the throttle valve so as to adjust the throttle valve opening to the final target opening, the device comprising:

a correction section for correcting the ISC request opening based on an amount of variation in the revolutional speed of the engine when the final target opening is identical to the ISC request opening, while prohibiting the correction of the ISC request opening when the final target opening is not identical to the ISC request opening.

2. A throttle valve control device in an internal-combustion engine according to claim 1, wherein the correction section corrects the ISC request opening based on, in addition to the amount of variation in the revolutional speed of the engine, a deviation between the revolutional speed of the engine and the target revolutional speed and a load variation.

3. A throttle valve control device in an internal-combustion engine according to claim 1, wherein when a temperature of a coolant of the internal-combustion engine is equal to or less than a predetermined temperature, the correction section prohibits any correction of the ISC request opening based on the amount of variation in the revolutional speed of the engine which would decrease the ISC request opening.

4. A throttle valve control device in an internal-combustion engine according to claim 1, wherein the correction section prohibits any correction of the ISC request opening based on the amount of variation in the revolutional speed of the engine which would decrease the ISC request opening, depending on the engine operation state.

5. A throttle valve control device in an internal-combustion engine according to claim 1, wherein the correction section prohibits any correction of the ISC request opening when the revolutional speed of the engine is equal to or greater than a predetermined revolutional speed.

6. A throttle valve control device in an internal-combustion engine according to claim 1, wherein the correction section determines a smoothed revolutional speed by averaging the revolutional speed of the engine, determines a dead zone based on the smoothed revolutional speed when the revolutional speed of the engine falls within a predetermined range, and prohibits any correction of the ISC request opening when the revolutional speed of the engine falls within the dead zone.

* * * * *